US008123083B2

(12) United States Patent
Papageorge

(10) Patent No.: US 8,123,083 B2
(45) Date of Patent: Feb. 28, 2012

(54) BOTTLE FOR FORMING AND SAFELY HOUSING ELEMENTAL IODINE AND DISPENSING ATTACHMENTS

(76) Inventor: Spyros J. Papageorge, Ponte Vedra, FL (US)

( * ) Notice: Subject to any disclaimer, the term of this patent is extended or adjusted under 35 U.S.C. 154(b) by 164 days.

(21) Appl. No.: 12/408,234

(22) Filed: Mar. 20, 2009

(65) Prior Publication Data

US 2010/0236641 A1 Sep. 23, 2010

(51) Int. Cl.
*B67D 7/76* (2010.01)

(52) U.S. Cl. ..... 222/190; 222/420; 210/266; 137/268

(58) Field of Classification Search ..... 137/268; 210/266, 282, 749, 753, 764; 222/420, 190
See application file for complete search history.

(56) References Cited

U.S. PATENT DOCUMENTS

| | | | | | |
|---|---|---|---|---|---|
| 3,354,883 | A | * | 11/1967 | Southerland | 604/88 |
| 3,408,295 | A | | 10/1968 | Vaichulis | |
| 3,698,605 | A | * | 10/1972 | Quisling | 222/190 |
| 4,384,960 | A | | 5/1983 | Polley | |
| 4,555,347 | A | * | 11/1985 | O'Dowd et al. | 210/752 |
| 5,275,736 | A | | 1/1994 | O'Dowd | |
| 5,545,315 | A | * | 8/1996 | Lonneman | 210/120 |

* cited by examiner

*Primary Examiner* — Kevin P Shaver
*Assistant Examiner* — Melvin Cartagena
(74) *Attorney, Agent, or Firm* — Daniel S. Polley, P.A.

(57) ABSTRACT

A bottle for the creation, storage, administration and dispensing of elemental iodine is disclosed. An amount of crystal iodine is safely housed at the bottom of the bottle. Water is poured into the bottle and contacts with the crystal iodine to form elemental iodine. With the crystal iodine safely secured at the bottom of the housing, the formed elemental iodine maintains contact with the crystal iodine to maintain its stability and extends is shelf life. Several dispensing device are also disclosed for dispensing or administering the elemental iodine, as needed, in order to treat internal and external areas of a human's or animal's body.

15 Claims, 5 Drawing Sheets

BOTTLE FOR FORMING AND SAFELY HOUSING ELEMENTAL IODINE AND DISPENSING ATTACHMENTS

FIELD OF THE INVENTION

The present invention relates generally to the creation of elemental iodine and particular to a bottle for forming, storing and dispensing elemental iodine.

BACKGROUND OF THE INVENTION

The medical benefits and uses for elemental iodine have been well documented. However, a bottle for easy housing and administration of the elemental iodine is needed. The present invention provides such a bottle for the creation, storage, administration and dispensing of elemental iodine and also stores the crystal iodine needed for forming the elemental iodine in a safe manner.

SUMMARY OF THE INVENTION

The invention provides a bottle for forming elemental iodine. The bottle includes a body member and a crystal iodine housing. The body member includes an elongated sidewall defining an elemental iodine storage area and has an open top end and an open bottom end. The iodine housing is sealingly secured to the bottom end of the body member to complete the bottom area of the bottle. One of several disclosed dispensing devices is secured to the top end of the body member to complete the top area of the bottle containing the elemental iodine. The selected dispensing device is used for administering the formed elemental iodine.

The bottle body member can be cylindrical in shape, though such is not considered limiting. The body member can be constructed from a polyethylene or polypropylene material or any other material(s) that is capable of safely holding and storing elemental iodine indefinitely.

The invention discloses three separate dispensing devices that can be secured to the top end of body member. However, it should be recognized that other dispensing devices can also be configured for securement to the top end of the body member for administering the elemental iodine and such other dispensing devices are also considered within the scope of the invention.

Of the three dispensing devices disclosed, the first device comprises a small cap that it can be snapped on at the top end of the body member, threaded onto the top end, or otherwise secured by conventional means. An opening is provided preferably in the center of the top surface of the cap for permitting the elemental iodine formed and stored in the body member by drops. The cap can be provided within a pivotal or otherwise secured cover for closing or covering the opening. The opening can also be associated within a conventional pivotal outlet which can be pivoted to a vertical position to remove elemental iodine by the drop and pivoted back downward into the cap top surface and closing off the iodine exit when storing the elemental iodine. The cover can again be secured to the cap over the top surface and pivot outlet, when the pivot outlet is in its down close position.

The second dispensing device includes an elongated tube or conduit member having a securing mechanism at one end for securing to the top end of the body member by any of the securing devices described above for the first cap dispensing device. Though not limiting, the elongated tube can slightly taper inward from its securement end to its outer end. In one non-limiting embodiment, the tube can extend about 4.5 inches in length. However, other shorter and longer lengths can be selected for the tube and all are considered within the scope of the invention. Relatively tiny or small holes are provided preferably all along the length of the elongated tube. With the second dispensing device secured to the bottle body member, by squeezing the bottle, such as but not limited to, at its midpoint, the formed elemental iodine will expel or exit through the various holes disposed in the elongated tube. This particular dispensing device is ideal for treating infections disposed in the anus or vagina area, as the elongated tube permits for deep penetration within the human or animal's body cavity and for direct administration of the elemental iodine within the body cavity.

The third dispensing device provides a pump or aerosol mechanism that is also similarly secured to the bottle body member as described above with the other dispensing devices. The third dispensing device will permit the formed elemental iodine to be sprayed out of the bottle for its intended use. An internal tube is disposed within the bottle body member to feed the elemental iodine up to the pump/aerosol mechanism for dispensing the elemental iodine out of an associated aperture.

A bottom member or plug is sealingly secured to the bottom end of the body member. The bottom plug houses the crystal iodine. A seal or screen retains the crystal iodine within the plug. Once the plug is secured to the bottom end of the body member, water, preferably distilled, in provided within the member and is permitted to travel through the seal or screen for contact with the crystal iodine. After an initial period, such as, but not limited to, twenty-four to about thirty-six hours from initial contact, the water is converted to elemental iodine at a consistency of about 40 parts per million (ppm). As the converted elemental iodine maintains contact with the crystal iodine housed within the plug, the consistency of the elemental iodine remains stable resulting in a relatively long shelf-life for the elemental iodine.

DETAILED DESCRIPTION OF THE INVENTION

Figure 1A:
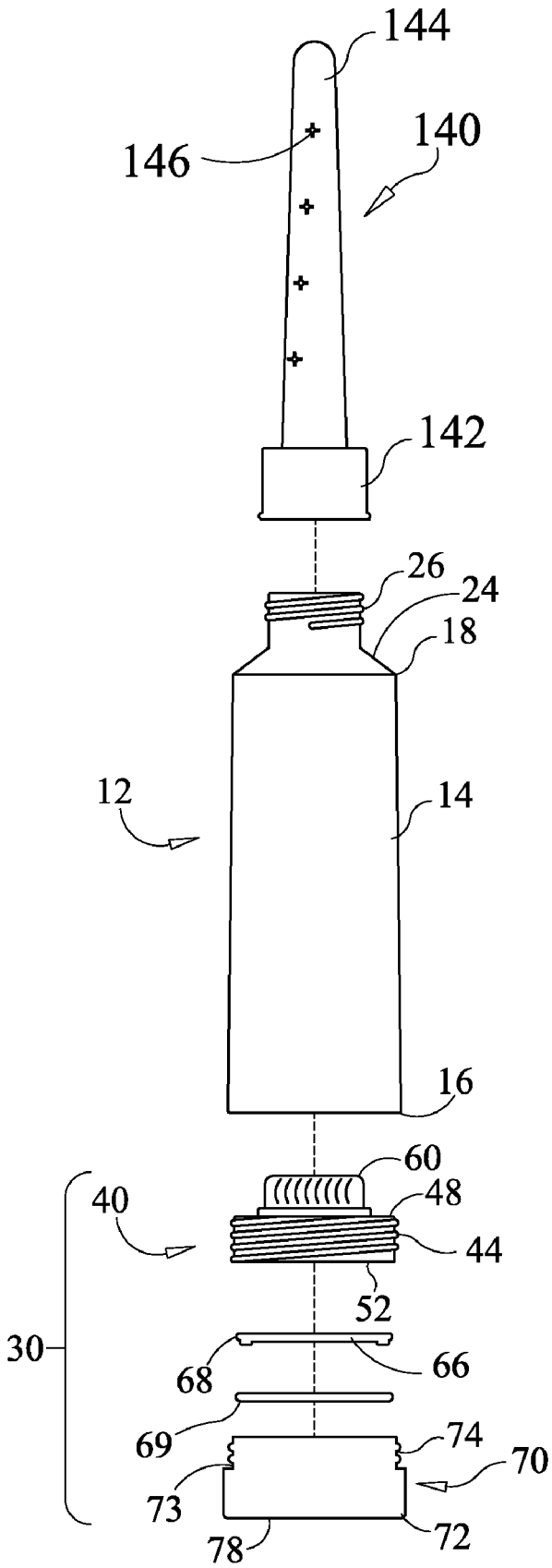
FIG. 1A is a front view of the present invention bottle for forming elemental iodine shown in an exploded view with a first dispensing attachment in accordance.
Figure 1B:
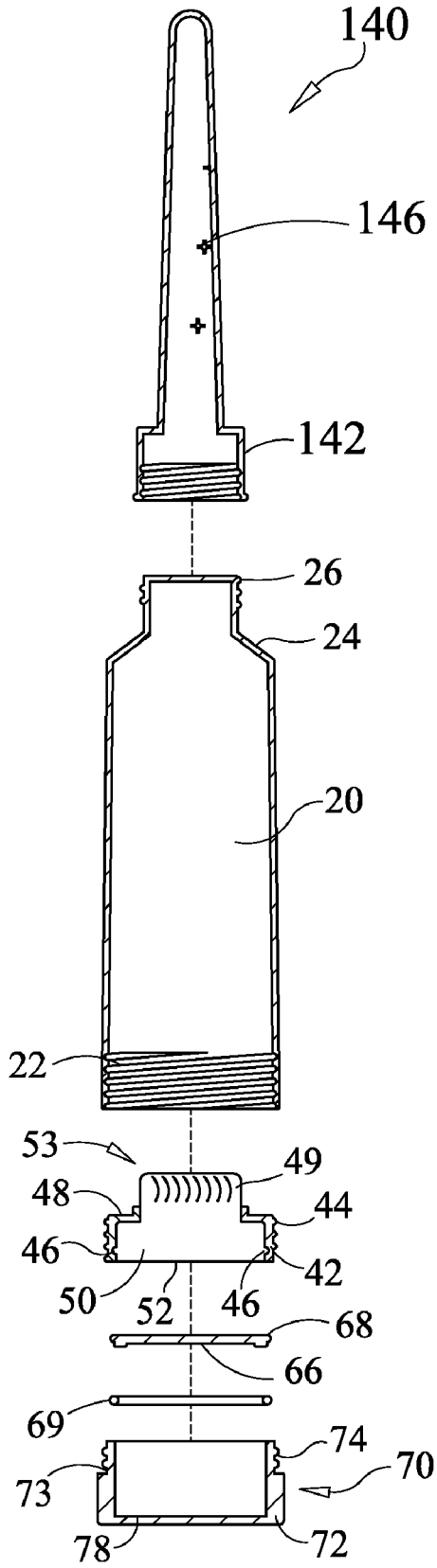
FIG. 1B is front sectional view of the bottle and dispensing attachment shown in FIG. 1A.
Figure 2A:
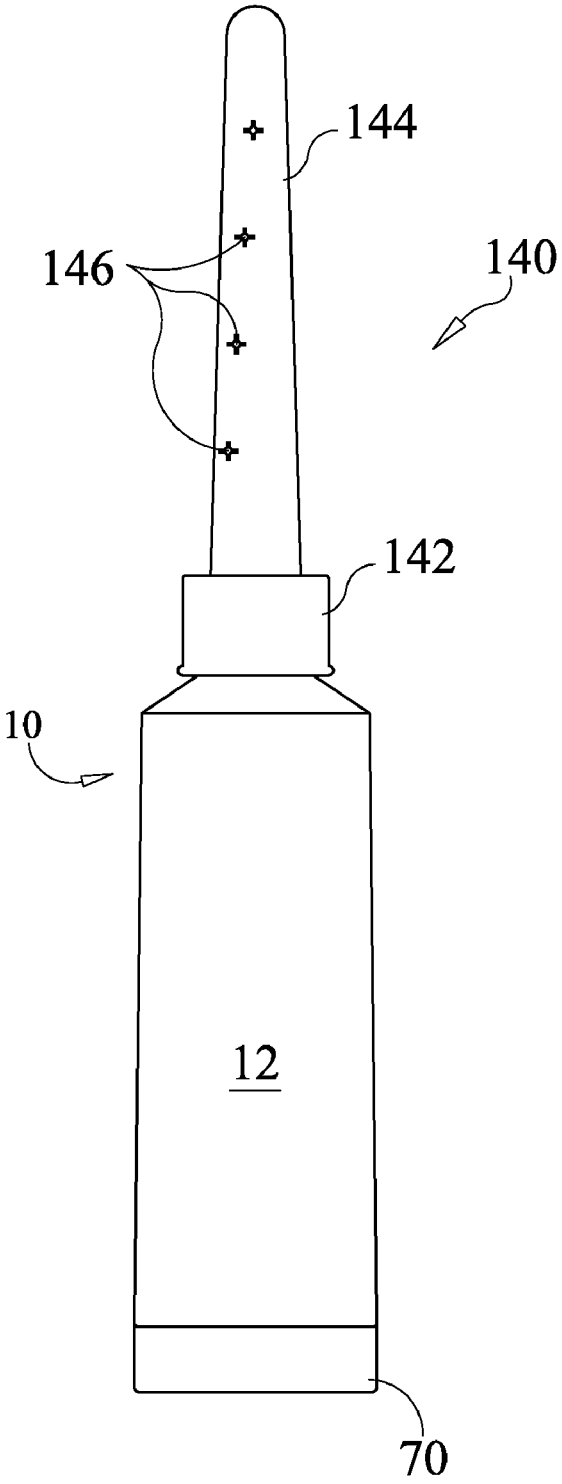
FIG. 2A is a front view of the bottle and dispensing element of FIG. 1A shown in an assembled view.
Figure 2B:
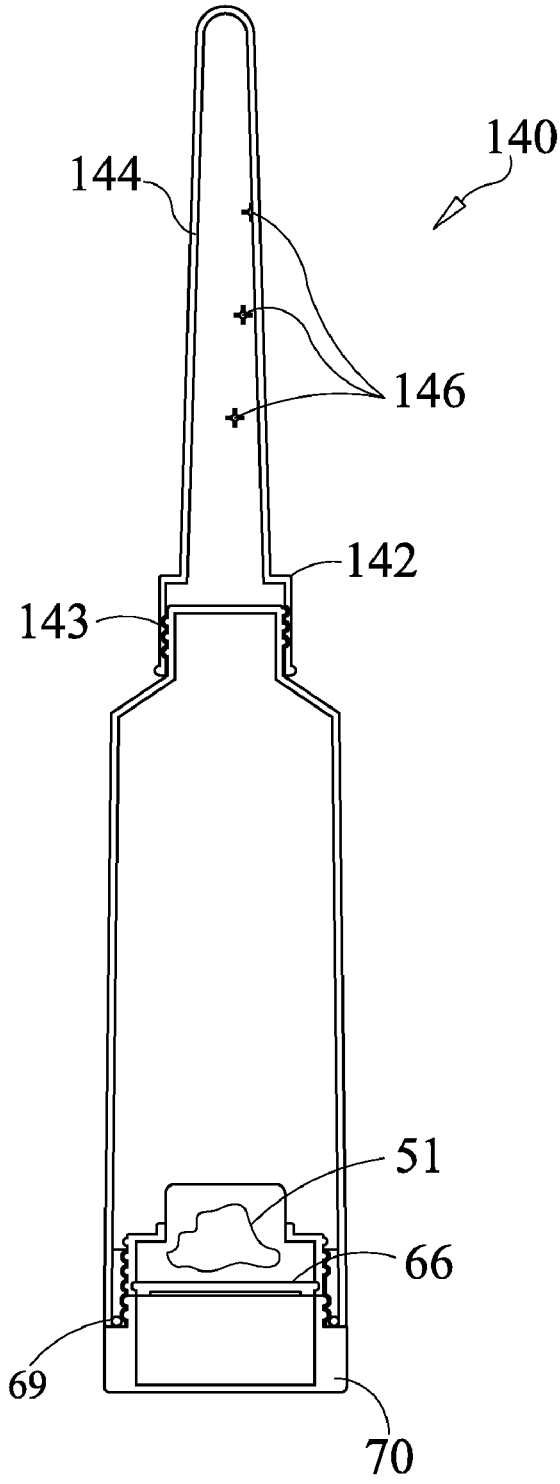
FIG. 2B is front sectional view of the bottle and dispensing attachment of FIG. 1A shown in an assembled view.

As seen in FIGS. 1A, 1B, 2A and 2B, a bottle for forming elemental iodine is shown and generally designated as bottle 10. Bottle 10 includes a main body member 12 and a crystal iodine storage housing 30. In one embodiment, body member includes 12 an elongated sidewall 14 defining an elemental iodine storage area 20 and has an open top end 18 and an open bottom end 16. Top end 18 is provided with a male securement 24 having external threading 26 for securement of one or more dispensing/administering devices ("dispensing devices"), which will be discussed in more detail below. The securement of the dispensing devices at top end 18 is not considered limited to any one particular securement, and other ways of securing a dispensing device to top end 18 are all considered within the scope of the invention. As one non-limiting example, external threads 26 can be removed and a sealed tight/snug connection can be achieved between the dispensing device and top end 18. Internal threading 22 can be provided at bottom end 16 for securement of the crystal iodine storage housing 30. The shown securement using internal threading 22 is not considered limiting and other securement techniques which will provide a sealed connection at bottom end 16 and which will prevent access or exposure to the crystal iodine by the user can be used and are all considered within the scope of the invention.

Body member 12 is preferably constructed from a plastic material which permits body member to be squeezed inward by the user to help force out elemental iodine from the dispensing device when certain dispensing devices are secured at top end 18. Other materials which will permit body member 12 to be squeezed inward and which will safely store and house crystal iodine and created elemental iodine can be used and are considered within the scope of the invention. Body member 12 can be cylindrical in shape, though such is not considered limiting and other shapes for body member 12 can be selected and are considered within the scope of the invention.

As mentioned above, body member 12 can be constructed from a plastic material, such as, but not limited to, a polyethylene or polypropylene material. Body member 12 can also be constructed from any other material(s) that is capable of safely holding and storing elemental iodine indefinitely, and which permits body member 12 to have some flexibility for squeezing inward. Where bottle 10 is to be used only with a spray/pump dispensing device it does not need to have the flexible, non-rigid characteristics for body member 12, as body member 12 will not have to be squeezed inward for administering or dispensing the elemental iodine stored within internal area 20 of body member 12.

Crystal iodine housing 30 is sealingly secured to bottom end 16 of body member 12 to complete the bottom area of bottle 10. One of several disclosed dispensing devices (discussed below) is secured to top end 18 of body member 12 to complete the top area of bottle 10 containing the elemental iodine. The selected dispensing device is used for administering the formed elemental iodine.

Figure 8:
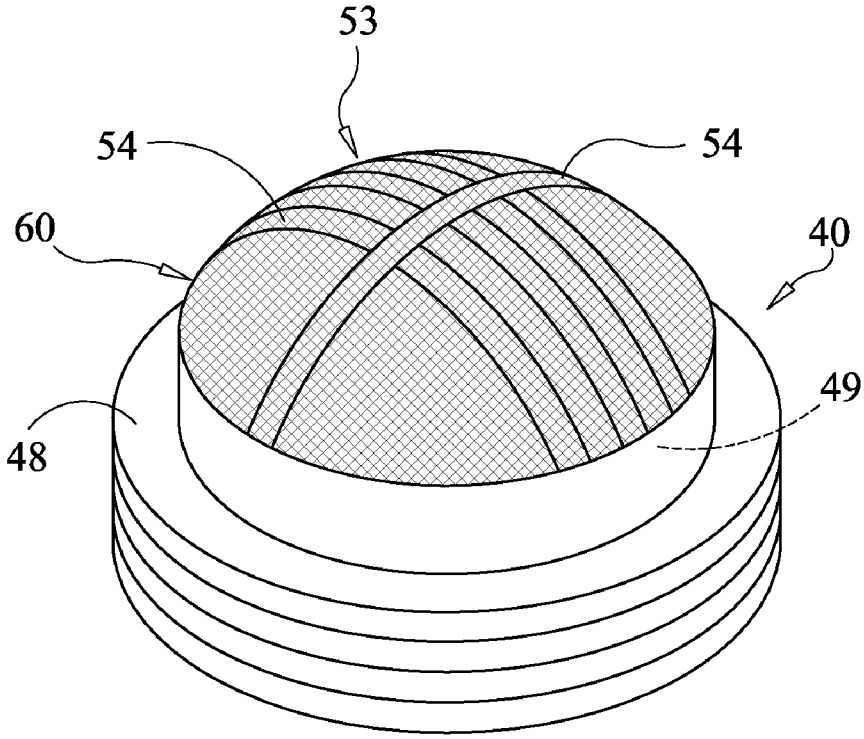
FIG. 8 is a perspective view of a second non-limiting embodiment for the crystal iodine storage housing.

Housing 30 comprises a top storage member 40, an internal bottom surface member 66 and a lower bottom plug or cap 70. Top storage member 40 includes a sidewall 42 having external threading 44 and an internal groove 46. Top storage member 40 also includes a lower open end 52 where internal passageway 50 begins. Extending upward from a top surface 48 of member 40 is a frame 53 which comprises at least one and preferably a plurality of frame portions 54, for supporting a porous or pervious seal, membrane or screen member 60. Preferably, porous seal member 60 is permanently secured to frame 53 by any conventional means, such as, but not limited to, heat sealing, etc. and all securement methods are considered within the scope of the invention. Frame 53 can form a substantially semi-circular or substantially semi-elliptical shape extending up from top surface 48 of top storage member 40 to provide for a substantially 180 degrees penetration area for the water to enter for contact with the crystal iodine. However, the semi-circular or semi-elliptical shape is not considered limiting and other shapes can be selected and all are considered within the scope of the invention. Furthermore, the height or width of frame 53 is not considered limited to any specific dimension any height or width can be selected (taken into consideration the dimensions of body member 12) and all are considered within the scope of the invention. Additionally, in lieu of a porous or pervious seal material or membrane for member 60, member 60 can also be constructed from a screen member (See FIG. 8) whose openings permit water to enter into storage area 49 to contact the crystal iodine, but are also small enough to help prevent or reduce any pieces of non-dissolved crystal iodine from escaping out of storage area 49. The porous or pervious seal material also prevents and any pieces of non-dissolved crystal iodine from escaping out of storage area 49.

With seal member 60 secured to frame 53, an enclosed storage area 49 is formed (excluding the bottom surface) for the crystal iodine. With the crystal iodine disposed within storage area 49 through insertion through passageway 50, bottom member 66 is inserted within passageway 50, which causes extended end or lip 68 to be inserted within internal groove 46 to permanently lock bottom member 66 to top storage member 40 and seal off storage area 49. O-rings, washers, etc. can be provided, as or if needed, to create a sealed connection between bottom member 66 and top storage member 40. Top storage member 40, bottom member 66 and seal member 60 are preferably constructed from materials which can come in contact with crystal iodine and elemental iodine without having their structural integrity compromised or otherwise affected.

In one securing embodiment, top storage member 40 is secured within body member 12 by the mating of internal threading 22 with the external threading of 44 on sidewall 42 of top storage member 40. Riding the threads to the top of internal threading 22 will properly position top storage member 40 in position within body member 12. Other ways for securing top storage member 40 within body member 12 can be used and are considered within the scope of the invention. Additionally, top storage member can be formed as part of body member 12 during the molding process to form a one-piece monolithically formed or integrally constructed member. All various ways of positioning top storage member 40 within body member can be used and all are considered within the scope of the invention. In all variations, top storage member 40 is secured at the bottom area within body member 12 and remains in place at or near bottom end 16 of body member 12. Top storage member 40 does not move around within storage area 20 once it is secured to body member 12.

Preferably, top storage member 40 is properly disposed within body member 12 before disposing the crystal iodine within storage area 49 and inserting bottom member 66 to seal off storage area 49. Alternatively, before disposing top storage member 40 in place within body member 12, the crystal iodine 51 can be disposed within storage area 49 and bottom member 66 property inserted and secured within passageway 50. In either method, the handler should wear protective gear, so as not to be exposed or otherwise come into contact with the crystal iodine.

Once storage member 40 (with bottom member 66 sealingly secured thereto and housing crystal iodine 51) is secured within body member 12 at bottom end 16, cap or plug 70 is ready to be secured to at bottom end 16 of body member 12. In the illustrated securement embodiment, after storage member 40 is secured within passageway 14 a lower portion of internal threads 22 remain available for use and mating with threading 74 on sidewall 72 of bottom cap or plug 70. The attachment of top storage member within passageway 14 and plug 70 at bottom end 16 is preferably permanent. To ensure that plug 70 will not be removed once secured at bottom end 16, one or more drops (and preferably at least three drops) of permanent glue or other permanent bonding or securing material can be applied on at least a portion of the outer area of sidewall 72, such as on threads 74 (when provided). Thus, once plug 70 is secured at bottom end 16, the permanent glue will prevent plug from being removed. This is preferred so as to reduce, if not eliminate, the user from opening up bottle 12 at bottom end 16 and coming into contact with or otherwise accessing the crystal iodine stored in storage area 49. Other methods and materials for permanently securing plug 70 to body member 12 at bottom end 16 can be used and are considered within the scope of the invention. Additionally, an o-ring 69 can be preferably disposed within an external groove 73 of sidewall 72 of plug 70 to provide a seal between plug 70 and body member 12 at bottom end 16 of body member 12. Plug 70 also includes a solid closed outer end 78.

As referenced above, the crystal iodine is housed within storage area 49 of top storage member 40. Seal, membrane or screen 60 secured to frame 53 in conjunction with bottom member 66 and a portion of sidewall 42 defines storage area 49 and retains crystal iodine 51 therein. Once plug 70 is secured to the bottom end of the body member, bottle 10 is ready to receive a supply of water for making elemental iodine. Water, preferably distilled, is provided into internal storage area 20 of body member 12 through top end 18. As the seal/screen 60 is porous or pervious, the water travels through seal/screen 60 and contacts and/or penetrates the crystal iodine stored within storage area 49. After an initial period, such as, but not limited to, twenty-four to about thirty-six hours from initial contact, the water is converted to elemental iodine at a consistency of about 40 parts per million (ppm). As the converted elemental iodine remains in storage area 49 until it used, the converted elemental iodine continues to maintain contact with the crystal iodine stored within storage area 49. This permits the consistency of the elemental iodine to remain stable, which results in a relatively long shelf-life for the elemental iodine contained within storage area 20.

As seen best in FIGS. 3 through 6, several dispensing/administering devices are illustrated that can be secured to the top end of body member. However, it should be recognized that other dispensing devices can also be configured for securement to the top end of the body member for administering the elemental iodine and such other dispensing devices are also considered within the scope of the invention.

Figure 5:
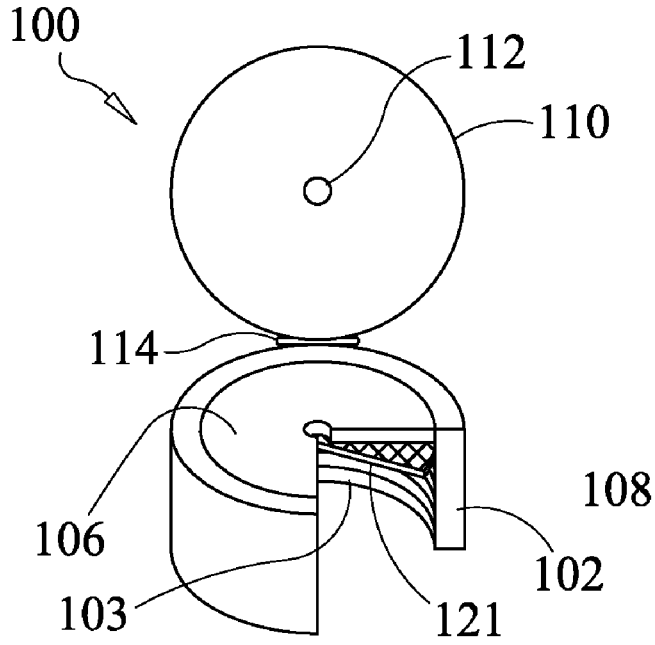
FIG. 5 is a perspective view of a third non-limiting dispensing attachment.
Figure 6A:
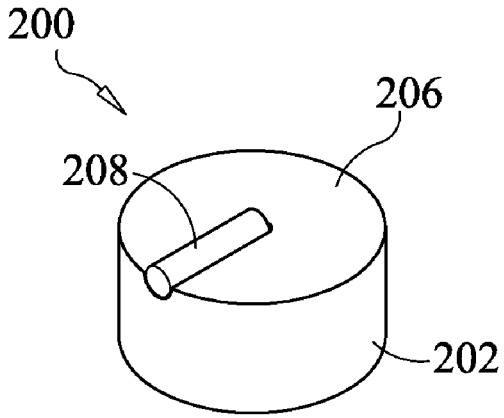
FIG. 6 is a perspective view of an alternative non-limiting third dispensing attachment.
Figure 6B:
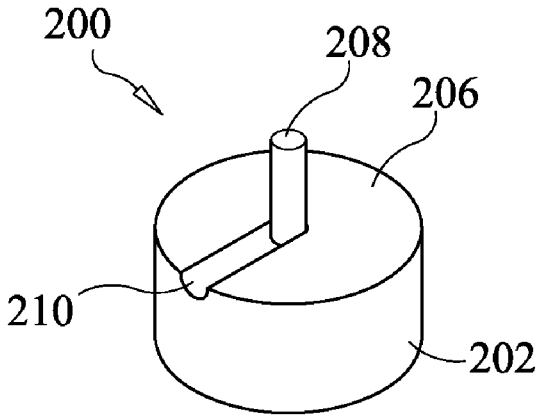
Figure 7:
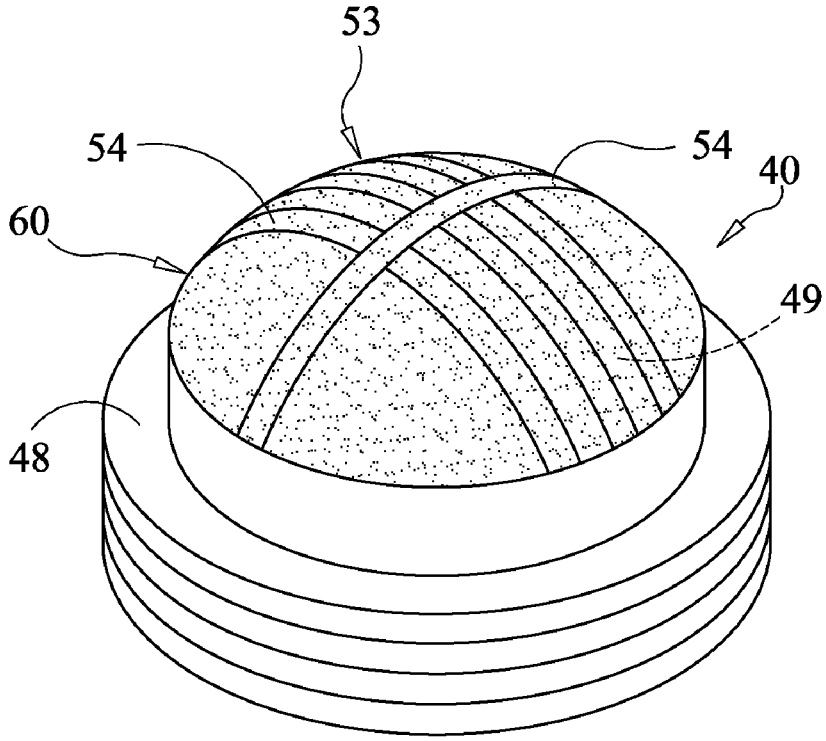
FIG. 7 is a perspective view of a first non-limiting embodiment for the crystal iodine storage housing.

As best seen in FIGS. 5 and 6, the first dispensing device is a drop dispensing cap designated generally as reference number 100 (FIG. 5) or 200 (FIG. 6). In the version illustrated in FIG. 5, drop dispenser 100 comprises a base 102 with an opening 108 and cover 110. Base 102 can be snapped on to top end 18 of body member 12, threaded onto top end 12 (see threads 103), or otherwise sealingly secured to top end 18 by conventional means. Opening 108 is provided preferably in the center of top surface 106 of base 102 and permits the elemental iodine formed and stored in storage area 20 of body member 12 to be administered or dispensed in drops form. Cover 110 is pivotally or otherwise secured to base 102 by a bridge member 114 for closing or covering opening 108. Cover 110 can be provided with a protrusion 112 (centered when opening 108 is centered). When cover 110 is in a closed position, protrusion 112 is disposed within opening 108 to further prevent elemental iodine from escaping. As also seen in FIG. 5, an internal porous or pervious material or screen member 121 can be disposed within base 102, to prevent any pieces of crystal iodine (or any debris from the water) from escaping out through opening 108. Any required o-rings, gaskets, washers, etc. for sealing the connection of drop dispenser 100 to top end 18 can also be used and are considered within the scope of the invention.

As seen in FIG. 6, an alternative cap drop dispensing embodiment is shown and generally designated as cap 200. In this embodiment, cover 110 can be eliminated an a pivotal elongated drop dispenser 208 is pivoted up from base 202 to dispense elemental iodine in drops and pivoted down into groove 210 in top surface 206 when in a closed position. Base 202 can be secured to top end 18 similar to how base 102 was described above. Additionally, a porous/pervious member, membrane or screen member and/or any needed o-rings, gaskets, washers, etc. can also be disposed within base 202 as described for base 102. Though preferably not containing a cover, it is within the scope of the invention to provide a cover like cover 110 and bridge 114 with this alternative drop dispensing embodiment. However, the cover would not require a protrusion, like protrusion 112 in cover 110.

Figure 3:
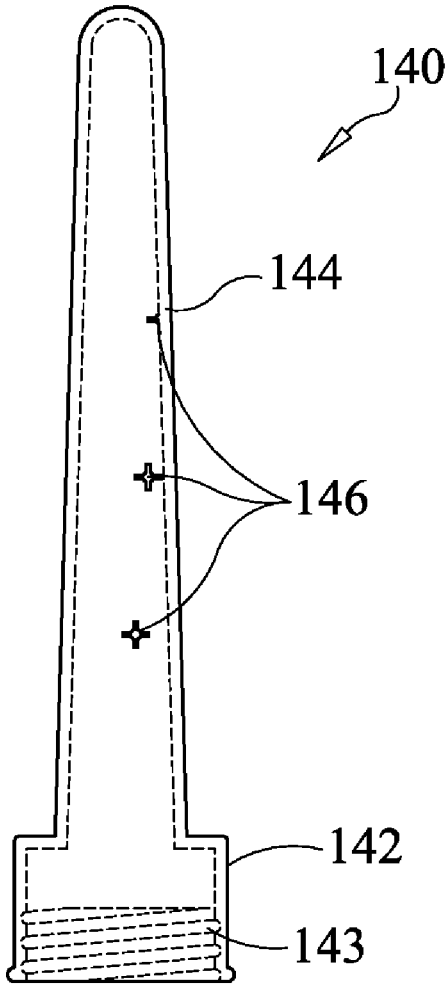
FIG. 3 is a front section view of the first non-limiting dispensing attachment.

A second dispensing device is illustrated in FIG. 3 and generally designated as dispensing probe 140. Probe 140 comprises an elongated tube or conduit 144 having a securing base 142 at one end for securing probe 140 to top end 18 of body member 12 similar to how cap 100 was described above to attach to top end 18. Base 142 is shown having internal threads 143, where base 142 is threadedly secured to top end 18. Though not limiting, elongated tube 144 can slightly taper inward from its securement end to its outer insertion end. In one non-limiting embodiment, tube 144 can extend about 4.5 inches in length. However, other shorter and longer lengths can be selected for tube 144 and all are considered within the scope of the invention. Relatively tiny or small holes or apertures 146 are provided preferably at various locations along the length of the elongated tube 144 and/or at the outer end of tube 144. With second dispensing device 140 secured to bottle body member 12, by squeezing body member 12, such as but not limited to, at its midpoint, the elemental iodine stored within storage area 20 will expel or exit through the various holes disposed in elongated tube 144. Probe 140 is particularly ideal for treating infections disposed in the anus or vagina area, as the elongated tube permits for deep penetration within a human or animal's body cavity and for direct administration of the elemental iodine within the body cavity to the infected internal area. A porous/pervious or screen member can also be disposed within base 142, similar to screen 121 as described for base 102.

Figure 4:
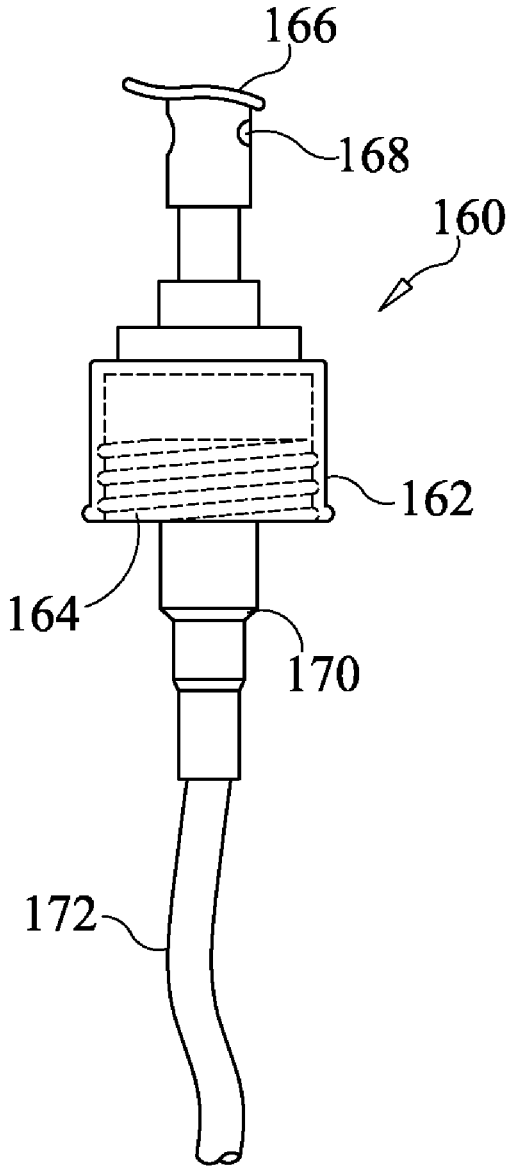
FIG. 4 is a front partial sectional view of a second non-limiting dispensing attachment.

A third dispensing device is illustrated in FIG. 4 and is generally designated as dispensing pump/aerosol/spray device 160 ("pump 160"). Pump 160 can also be similarly secured to top end 18 of bottle body member 12 through a base 162 as described above with the other dispensing devices. Pump 160 permits formed elemental iodine to be sprayed out of bottle 12 through an exit aperture 168 in the actuator 166. A tube 172 is secured and in communication with actuator 166 through conventional manifold components 170. When base 162 is secured to top end 18, tube 172 is disposed within storage area 20 of body member 12. Preferably, the length of tube 172 is selected to correspond to or be substantially the same as the length of storage area 20 such that when pump 160 is secured to top end 18, the open outer end of tube 172 is approximate to bottom end 16 of body member 12 which permits tube 172 to reach basically all of the formed elemental iodine contained in storage area 20. However, it is also within the scope of the invention that the length of tube 172 can be any length and not necessarily required to reach the bottom of storage area 20. Pump 160 permits the formed elemental iodine to be sprayed onto the area needed to be treated.

Though not shown, when storing the bottle 10 with the elemental iodine stored inside, a conventional cap, not having an opening or dispensing mechanism, can be secured to top end 18, to provide for a better seal of the contents within bottle 10. The storage cap can be attached to top end 18 similar to the dispensing devices described above.

As shown above, the present invention provides for a safe and easy way of creating elemental iodine, as well as providing for several ways of dispensing or administering the elemental iodine. The crystal iodine is securely stored at the bottom of body member 12 and is inaccessible to the user to prevent injury to the user. As the formed elemental iodine in storage area 14 maintains contact with the crystal iodine in storage area 49, the elemental iodine remains stable and increases its shelf life. It should also be recognized that once elemental iodine is formed from the water contacting the crystal iodine (i.e. the saturation point), through testing it is believed that the potency of the elemental iodine (ppm) does not remain constant after reaching the saturation point. Rather, by remaining in contact with the crystal iodine, the potency of the elemental iodine will continue to increase. However, at some point in time after the saturation point, it is expected that the potency of elemental iodine in ppm will reach a maximum and will no longer increase in potency.

Bottle 10 is preferably of a size which can be hand held, though other sizes can also be selected and all are within the scope of the invention.

It will be seen that the objects set forth above, and those made apparent from the foregoing description, are efficiently attained and since certain changes may be made in the above construction without departing from the scope of the invention, it is intended that all matters contained in the foregoing description shall be interpreted as illustrative and not in a limiting sense. The instant invention has been shown and described herein in what is considered to be the most practical and preferred embodiment.

In all embodiments, various conventional sealing devices such as, but not limited to, washers, o-rings, gaskets, screens, filters, etc. can be placed where necessary for preventing leakage of water or elemental iodine and/or any crystal iodine.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A bottle for forming elemental iodine, said bottle comprising:

a body member having an internal storage area and a top end and an opposite closed bottom end;

a water porous member disposed within storage area and permanently positioned at a single location within said internal storage area to divide the internal storage area into a first portion and a second portion, said first portion being between said water porous member and said top end of said body member and second portion being between said water porous member and the closed bottom end of said body member;

an amount of crystal iodine housed and fully enclosed within said second portion of said internal storage area, said amount of crystal iodine remains disposed within said second portion at all times until dissolved;

a dispensing device connector disposed at the top end of said body member; and a crystal iodine storage housing permanently secured to the bottom end of said body member, said crystal iodine is retained within said storage housing, said storage housing positioned within the internal storage area of said body member such that said storage housing is fully enclosed within the internal storage area of said body member;

wherein said crystal iodine storage housing comprising:

a top storage member having a sidewall, a top surface and a frame extending upward from said top surface, said sidewall defining a passageway, wherein said water a porous member secured to and supported by said frame; and a bottom member secured within the passageway;

wherein said water porous member secured to said frame and said bottom member collectively define the storage area for said crystal iodine.

2. The bottle of claim 1 wherein an amount of water is disposed within said storage area and is permitted to travel through said water porous member and make contact with said amount of crystal iodine to create elemental iodine.

3. The bottle of claim 2 wherein the formed elemental iodine remains in contact with the crystal iodine while being stored within the internal storage area of said body member.

4. The bottle of claim 1 wherein said dispensing device is a drop dispensing cap.

5. The bottle of claim 1 wherein said dispensing device is a probe.

6. The bottle of claim 5 wherein said probe comprises an elongated tube secured to a base, said elongated tube having a plurality of apertures serving as exit points for the elemental iodine.

7. The bottle of claim 1 wherein said dispensing device is a spray or pump assembly.

8. The bottle of claim 7 wherein said spray or pump assembly having a tube member extending into the internal storage area of said body member such that said tube member is in direct contact with the created elemental iodine disposed within the internal storage area for feeding elemental iodine to an actuator portion of said spray or pump assembly.

9. The bottle of claim 1 wherein said sidewall of said top storage member having an internal groove and an outer portion of said bottom member disposed within said internal groove for permanently securing said bottom member to said top storage member within the passageway of said top storage member.

10. The bottle of claim 1 wherein said top storage member with attached bottom member and housing said crystal iodine is secured to an inner surface of said body member within the internal storage area of said body member approximate to the bottom end of said body member.

11. The bottle of claim 10 wherein said top storage member having outer threads and a inner surface portion of said body member being threaded, wherein said top storage member is secured within said internal storage area by a threaded securement between the outer threads of said top storage member and the threaded inner surface portion of said body member.

12. The bottle of claim 1 wherein said bottom end of said body member is closed by the permanent securement of a plug member at the bottom end of said body member once said crystal iodine has been disposed within the internal area of said body member.

13. The bottle of claim 12 wherein said plug having an outer diameter and said body member at said bottom end having an outer diameter; wherein the outer diameter of said plug is substantially the same as the outer diameter of said body member at said bottom end.

14. The bottle of claim 1 wherein said frame is semi circular or semi elliptical in shape.

15. The bottle of claim 1 wherein said body member housing the internal storage area, water porous member and crystal iodine is a one piece member.

* * * * *